United States Patent [19]

Akiya

[11] 4,285,887

[45] Aug. 25, 1981

[54] CARBURETOR

[75] Inventor: Kiyoshi Akiya, Ageo, Japan

[73] Assignee: Honda Giken Kogyo Kabushiki Kaisha, Tokyo, Japan

[21] Appl. No.: 113,041

[22] Filed: Jan. 17, 1980

[30] Foreign Application Priority Data

Jan. 29, 1979 [JP] Japan ..... 54-9396
Oct. 6, 1979 [JP] Japan ..... 54-129336

[51] Int. Cl.[3] ..... F02M 7/08

[52] U.S. Cl. ..... 261/34 A; 261/41 D; 261/DIG. 39

[58] Field of Search ..... 261/34 A, DIG. 39, 41 D

[56] References Cited

U.S. PATENT DOCUMENTS

| | | | |
|---|---|---|---|
| 1,857,889 | 5/1932 | Sturm | 261/56 |
| 2,123,485 | 7/1938 | Moore | 261/34 A |
| 2,246,825 | 6/1941 | Winfield | 261/34 A |
| 2,502,679 | 4/1950 | Stanly | 261/34 A |
| 2,544,083 | 12/1970 | Currie | 261/DIG. 78 |
| 3,290,023 | 12/1966 | Sarto | 261/34 A |
| 3,295,839 | 1/1967 | Mitchell | 261/56 |
| 3,519,407 | 7/1970 | Hilborn | 261/DIG. 39 |
| 3,608,874 | 9/1971 | Beckmann | 261/41 D |
| 3,620,511 | 11/1971 | Reinhardt et al. | 261/41 D |
| 3,814,389 | 6/1974 | August | 261/41 D |
| 3,944,634 | 3/1976 | Gerlach | 261/41 D |
| 4,132,203 | 1/1979 | Elpern et al. | 261/DIG. 78 |
| 4,217,313 | 8/1980 | Dmitrievsky et al. | 261/41 D |

FOREIGN PATENT DOCUMENTS

| | | | |
|---|---|---|---|
| 131462 | 8/1932 | Austria | 261/34 A |
| 506314 | 3/1976 | U.S.S.R. | 261/41 D |

*Primary Examiner*—Tim R. Miles
*Attorney, Agent, or Firm*—Haseltine and Lake

[57] ABSTRACT

A carburetor herein disclosed includes a low speed spray aperture defined on the side wall of an intake duct at a position opposed to a throttle valve inside the intake duct and feeding a fuel for low speed operation in accordance with the degree of opening of the throttle valve, and a by-pass passage having, on the side wall portion of the intake duct, an intake port and a controlling stream spray port whereby the former is defined on the upstream side of the throttle valve and the latter, on the downstream side of the throttle valve. The by-pass passage incorporates therein a controlling nozzle which sprays a jet stream towards the controlling steam spray port. In accordance with an embodiment of the invention, an acceleration nozzle is additionally disposed in the by-pass passage, the nozzle opening into the by-pass passage on the upstream side of the controlling nozzle and spraying an acceleration fuel into the by-pass passage. In accordance with another embodiment of the invention, the intake duct is connected with an intake manifold having branch conduits leading to respective combustion chambers of a plurality of cylinders of an engine. The bypass passage has a plurality of controlling stream spray ports, each of which opens into each of the branch conduits.

7 Claims, 6 Drawing Figures

CARBURETOR

BACKGROUND OF THE INVENTION

This invention relates to a carburetor and more specifically to a carburetor which is easy for quality control and which can ensure a good fuel consumption rate in an engine and satisfactory engine performance.

It is desirable that fuel particles admixed in an air stream by a carburetor be turned into particles having a particle size as minute as possible in the atomized state. In the conventional carburetor, however, perfect atomization of the fuel particles has been extremely difficult and hence, feeding of a part of the fuel particles into the engine while not yet atomized perfectly has been unavoidable. When an air-fuel mixture is fed from a single carburetor to each cylinder of an engine having a plurality of cylinders, it is preferred that fuel be uniformly distributed to each cylinder. However, it is by no means easy to obtain a uniform air-fuel mixture by atomizing the fuel to an ideal extent or to uniformly distribute the fuel from a single carburetor to each cylinder of an engine having a plurality of cylinders. Also, various difficulties have conventionally been encountered especially in atomizing the fuel for acceleration at the time of acceleration and at the same time, in uniformly distributing the acceleration fuel so atomized into plural cylinders. Further, if an attempt is made to improve the acceleration response characteristics of the engine, the construction of the carburetor ordinarily becomes complicated and hence, an increase in the cost of production is unavoidable.

In a carburetor of the type which generates a dilute air-fuel mixture to cope with emission of exhaust gases, a high level of techniques in quality control, machining and maintenance of the carburetor have been necessary for sufficiently ensuring good engine startability, pleasant feeling is low speed driving and satisfactory acceleration response of the engine. In consequence, the carburetor becomes further complicated in its construction and more expensive in its cost of production.

SUMMARY OF THE INVENTION

The carburetor according to the present invention is equipped with a low speed spray aperture for feeding a fuel for low speed operation in accordance with the degree of opening of a throttle valve on the side wall portion of an intake duct at a position opposed to the throttle valve and with a by-pass passage including an intake port and a controlling stream spray port whereby the former is defined on the side wall portion of the intake duct at a position upstream of the throttle valve while the latter is defined on the side wall portion of the intake duct at a position downstream of the throttle valve. This by-pass passage incorporates therein a controlling nozzle which generates a jet stream towards the controlling stream spray port. In accordance with an embodiment of the present invention, there is disposed inside the by-pass passage an acceleration fuel nozzle which is open to the by-pass passage on the upstream side of the controlling nozzle and sprays an acceleration fuel into the by-pass passage. In accordance with another embodiment of the invention, the intake duct has, on the downstream side of the throttle valve, a manifold portion which distributes and feeds an air-fuel mixture to each combustion chamber of a plurality of cylinders of the engine and the abovementioned controlling stream spray port is open to each cylinder at a position downstream the manifold portion of the intake duct.

It is therefore an object of the present invention to provide a carburetor which enables a homogeneous air-fuel mixture to be obtained by effectively promoting the atomization of fuel particles.

It is another object of the present invention to provide a carburetor which enables fuel to be distributed uniformly to a plurality of cylinders of an engine, thereby to promote complete combustion of the fuel in the engine and improve the fuel consumption.

It is still another object of the present invention to provide a carburetor which enables detrimental components in the exhaust gas such as hydrocarbons, carbon monoxide and so forth to be decreased, and to improve various engine performance such as the engine startability, low speed driving feeling, acceleration response and so forth.

It is still another object of the present invention to provide a carburetor which is simple in construction, and which can be measured and tested with a simple testing instrument, thereby allowing good quality to be fully ensured.

DESCRIPTION OF THE PREFERRED EMBODIMENTS

Figure 1:
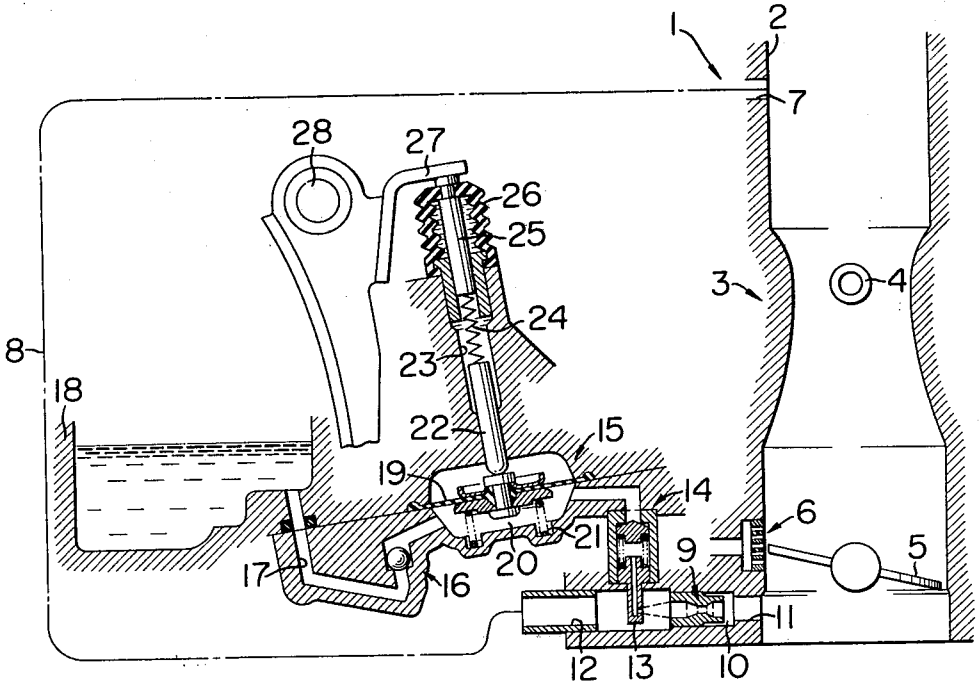
FIG. 1 is an enlarged, schematic sectional view showing the principal portions of the carburetor in accordance with an embodiment of the present invention.

Referring initially to FIG. 1, a venturi portion 3 is defined in an intake duct 2 of a carburetor 1 and a high speed spray aperture 4 is disposed in this venturi portion 3 for feeding a fuel during the high speed operation of the engine. Inside the intake duct 2, a throttle valve 5 is disposed on the downstream side of the high speed spray aperture 4 while a low speed spray aperture 6, which feeds the low speed fuel in accordance with the degree of opening of the throttle valve 5, is defined on the side wall of the intake duct 2 that opposes the throttle valve 5.

On the side wall of the intake duct 2 on the upstream side of the venturi portion 3, there is defined an intake port 7 of a by-pass passage 8 for sucking the air while detouring the throttle valve 5, and on the side wall of the intake duct 2 on the downstream side of the throttle valve 5, there is defined a controlling stream spray port 11 which promotes the atomoization of the fuel particles in the air-fuel mixture on the downstream side of the throttle valve 5, by spraying the air sucked through the by-pass passage 8, as a controlling stream.

Inside a guide passage 12 forming the outlet portion of the by-pass passage 8, there are arranged a controlling nozzle 9 and a jet stream adjusting chamber 10. The controlling nozzle 9 jets and accelerates the air sucked through the by-pass passage 8 towards the controlling stream spray port 11 while the jet stream adjusting chamber 10 converts, between the controlling nozzle 9 and the controlling stream spray port 11, the air sprayed from the controlling nozzle 9 into a suitably turbulent, dispersed air and jets it from the controlling stream spray port 11 into the intake duct 2.

An acceleration fuel nozzle 13 is open on the upstream side of the controlling nozzle 9 inside the guide passage 12 and is constructed such that it communicates with a fuel tank 18 via a discharge valve 14, a pump chamber 20 of an acceleration pump 15, an intake valve 16 and a fuel pipe 17. The acceleration pump 15 is a diaphragm pump whose diaphragm 19 is under the bias of a restoring spring 21 on its one side and is urged by a push rod 22 on the other side, said push rod 22 sliding inside a slide contact hole 23. Inside the slide contact hole 23, the push rod 22 is arranged to receive the pushing force of a pressure-receiving rod 25 via a push spring 24, and the pressure-receiving rod 25 has in turn its protruding portion protruding from the slide contact hole 23 and encompassed by a dust-proof bellows 26. The outer end portion of the pressure-receiving rod 25 is allowed to butt against a push arm 27 which is pivoted at a pivot portion 28. The push arm 27 is interlocked with the throttle valve 5 via a mechanism not shown in such an arrangement that it pushes the pressure-receiving rod 25 at the time of the opening action of the throttle valve 5.

Thus, when the throttle valve 5 is rapidly opened so as to accelerate the engine revolution, the push arm 27 rapidly pushes the pressure-receiving rod 25 so that its pushing force is transmitted to the diaphragm 19 via the spring 24 and the push rod 22 and imparts the discharge action to the diaphragm 19. Hence, the fuel inside the pump chamber 20 pushes and opens the discharge valve 14 and is pressure-fed into the acceleration fuel nozzle 13. Incidentally, the fuel inside the pump chamber 20 is one which is sucked from the fuel tank 18 into the pump chamber 20 via the intake valve 16 due to the sucking action of the diaphragm 19 which is caused by the restoring force of the restoring spring 21 when the throttle valve 5 is closed.

The fuel that is pressure-fed into the acceleration fuel nozzle 13 is jetted from its nozzle into the air stream passing through the guide passage 12. In this instance, the air stream sprayed from the controlling nozzle 9 is fed into the controlling stream spray port 11 past through the jet stream adjusting chamber 10, but the fuel particles in the air stream are further atomized in the course of jetting through the controlling nozzle 9 while the jet air stream sprayed from the controlling nozzle 9 is converted into a suitably turbulent flow to form a homogeneous air-fuel mixture inside the jet stream adjusting chamber 10.

The opening of the throttle valve 5 is small at the time of the start of the engine or during the low speed operation of the engine so that the internal pressure inside the intake duct on the downstream side of the throttle valve 5 is remarkably lower than that inside the intake duct on the upstream side. Under this state, the fuel is primarily fed from the low speed spray aperture 6 which is opposed to the throttle valve 5. However, it is difficult, especially at the engine start and during its low speed operation, to cause the air-fuel mixture to flow inside the intake duct in the uniformly distributed state partly because the low speed spray aperture 6 is defined on the side wall of the intake duct 2 and partly because the air stream fed from the upstream side of the throttle valve 5 flows through the gap between the throttle valve 5 and the inner wall surface of the intake duct 2. Generally speaking, the fuel particles in the air-fuel mixture are apt to be deposited onto the wall surface of the intake duct 2 and at the same time, can not easily be atomized.

In accordance with the present invention, however, since the controlling stream spray port 11 is defined on the downstream side of the throttle valve 5, the controlling stream sprayed from this spray port 11 suitably disturbs the air-fuel mixture on the downstream side of the throttle valve 5 into a turbulent flow whereas the air-fuel mixture stream along the wall surface of the intake duct 2 is pushed towards the central portion of the intake duct 2, thus preventing the fuel particles of the air-fuel mixture from attaching onto the wall surface of the intake duct 2 and promoting the atomization of the fuel particles and rendering them further minute.

Moreover, the smaller the opening of the throttle valve 5, the stronger the sucking force which sucks the air from the controlling stream spray port 11. For this reason, the air stream spray action of the controlling stream spray port 11 at the engine start and during the low speed operation of the engine becomes more effective. Since the acceleration fuel is jetted from the acceleration fuel nozzle 13 and is then sprayed as the air-fuel mixture from the controlling stream spray port 11, the acceleration response characteristics of the engine can be improved to a marked extent.

Figure 2:
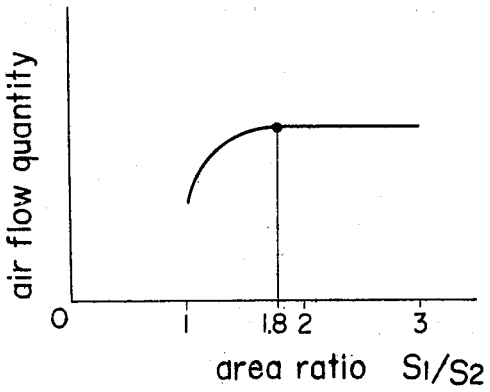
FIG. 2 is a graph showing the change in the flow quantity of an air stream passing through the by-pass passage where the abscissa represents the ratio of the cross-sectional area of the controlling stream spray port to the cross-sectional area of the minimum diameter portion of the controlling nozzle inside the by-pass passage.

FIG. 2 is a graphical representation of the change in the flow quantity of the air stream in which the abscissa indicates the ratio of set area $S_1/S_2$, where $S_1$ is a cross-sectional area of the controlling stream spray port 11 and $S_2$ is a cross-sectional area of the minimum diameter portion of the controlling nozzle 9, and the ordinate indicates the flow quantity, per unit time, of the air stream sprayed from the spray port 11 at that time. As can be seen clearly from this graph, in order to efficiently ensure the flow quantity of the air stream sprayed from the controlling stream spray port 11 without loss, it is preferred to set the cross-sectional area $S_1$ of the controlling stream spray port 11 and the cross-sectional area $S_2$ of the minimum diameter portion of the controlling nozzle 9 so as to satisfy the relationship as shown below.

$$S_1/S_2 \geqq 1.8 \text{ or } S_1 \geqq 1.8S_2$$

So long as the opening of the throttle valve 5 is small, the fuel is fed primarily from the low speed spray aperture 6. In order to especially prevent attachment of the fuel particles supplied from this aperture 6 onto the wall portion of the intake duct 2 and to promote the atomization of these fuel particles, it is preferred that the controlling stream spray port 11 be defined at the same azimuth as that of the low speed spray aperture 6.

Figure 3:
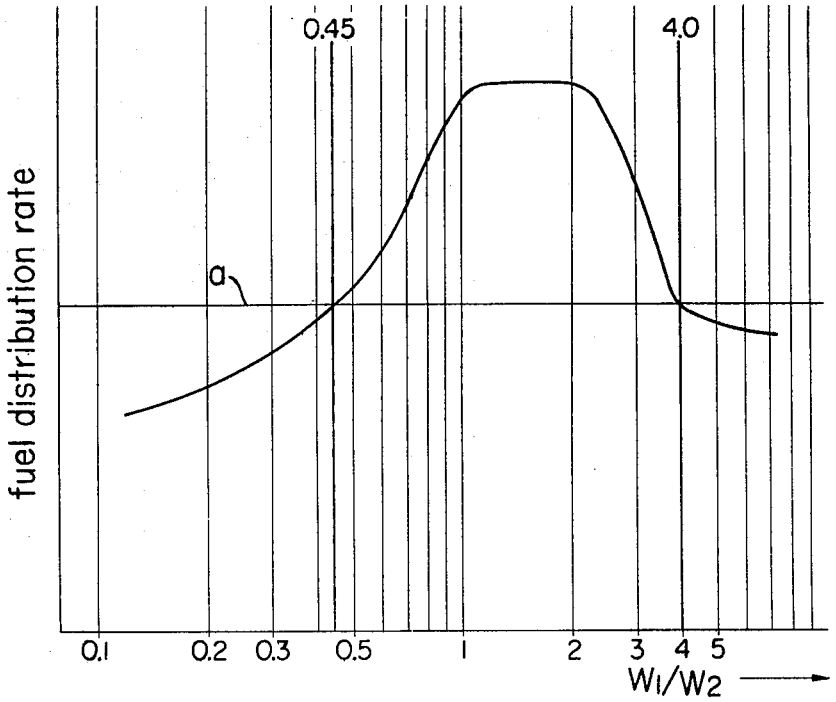
FIG. 3 is a graph showing the distribution rate of the fuel to the plural cylinders where the abscissa represents the ratio of the open width of the controlling stream spray port to the maximum distribution width of the low speed spray aperture.
Figure 4:
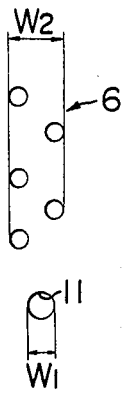
FIGS. 4 and 5 are schematic views showing varying arrangement of the low speed spray aperture and the controlling stream spray port, respectively.
Figure 5:
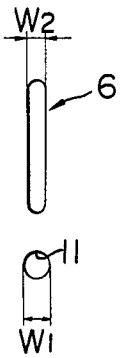

FIG. 3 shows the relationship between a ratio $W_1/W_2$ and a distribution rate, each having the meaning defined below with reference to FIGS. 4 and 5. First, symbol $W_1$ represents an open width of the controlling stream spray port 11 in the inner circumferential direction of the intake duct 2 which port is formed in the same direction as the low speed spray aperture 6 and symbol $W_2$ represents the maximum distribution width of the low speed aperture 6 in the inner circumferential direction of the intake duct 2. This ratio $W_1/W_2$ is plotted on the abscissa. Next, the term "distribution rate" represents a distribution rate to plural cylinders and is plotted on the ordinate. In other words, FIG. 3 is a graphical representation of a change in the distribution rate in the case where the fuel particles in the air-fuel mixture are atomized and thus distributed uniformly to each cylinder. Transverse line a represents an allowable critical value of the deviation of the fuel to be distributed to each cylinder. As can be seen clearly from this FIG. 3, in order to control the flow condition of the air-fuel mixture so that the degree of deviation of the fuel to be distributed into the plural cylinders falls within the limit of the allowable critical value, it is preferred to set the open width $W_1$ of the controlling stream spray port 11 and the maximum distribution width $W_2$ of the low speed spray aperture 6 so as to satisfy the following relationship;

$$W_1/W_2=0.45\text{–}4.0$$

In FIG. 1, the controlling stream spray port 11 is shown disposed to open to the inner wall surface of the intake duct 2. In order to effectively control the distribution condition of the air-fuel mixture on the downstream side of the throttle valve 5, however, it is also possible to form the controlling stream spray port 11 so as to protrude into the intake duct 2.

Due to the abovementioned arrangement, when the engine is operated with the throttle valve 5 open slightly, the pressure decreases inside the intake duct 2 on the downstream side of the throttle valve 5 whereby the fuel for the low speed operation is sucked from the low speed spray aperture 6 while the air is also sucked from the intake port 7 via the by-pass passage 8. The air thus sucked from the intake port 7 is then sprayed into the intake duct 2 on the downstream side of the throttle valve 5. In this instance, if the acceleration fuel is jetted from the acceleration fuel nozzle 13, the jetted fuel particles are atomized while they pass through the controlling nozzle 9 and the jet stream adjusting chamber 10 and are then sprayed from the controlling stream spray port 11 in the uniformly distributed state.

The air stream that flows towards the downstream side of the throttle valve 5 past through the gap between the peripheral portions of the throttle valve 5 and the inner wall surface of the intake duct 2, especially the air-fuel mixture containing the fuel particles supplied from the low speed spray aperture 6, is pushed to the central portion of the intake duct 2 away from the positions close to the wall surface of the intake duct 2 by the air stream that is jetted from the controlling stream spray port 11, is thus made suitably turbulent and promotes the atomization and further reduction of the size of the fuel particles in the air-fuel mixture on the downstream side of the throttle valve 5.

As the opening of the throttle valve 5 becomes greater, the air stream inside the intake duct 2 on the upstream side of the throttle valve 5 becomes more easy to flow towards the downstream side of the throttle valve 5 and at the same time, the suction force acting on the controlling stream spray port 11 becomes weaker. In consequence, the air-fuel mixture containing the fuel particles jetted from the high speed spray aperture 4 is primarily fed to the downstream side of the throttle valve 5.

Instead of the conventional quality control by the use of the fuel flowing through a flow stand, in the carburetor 1 illustrated in FIG. 1, it is possible to employ a measuring method which comprises the steps of generating a specified sonic with an air flow meter, selecting the opening of the throttle valve 5 so that the pressure at the low speed spray aperture 6 reaches a specified pressure and then selecting the controlling nozzle 9 in order to bring the air quantity sucked by the intake duct 2 into conformity with a specified value. This measuring method makes it possible to carry out adjustment and measuring inspection at a high level of accuracy within an extremely short period of time and to improve the production efficiency. Since it uses only air but not any inflammable matters, the measuring method can ensure the safety of the adjustment and measuring inspection.

Figure 6:
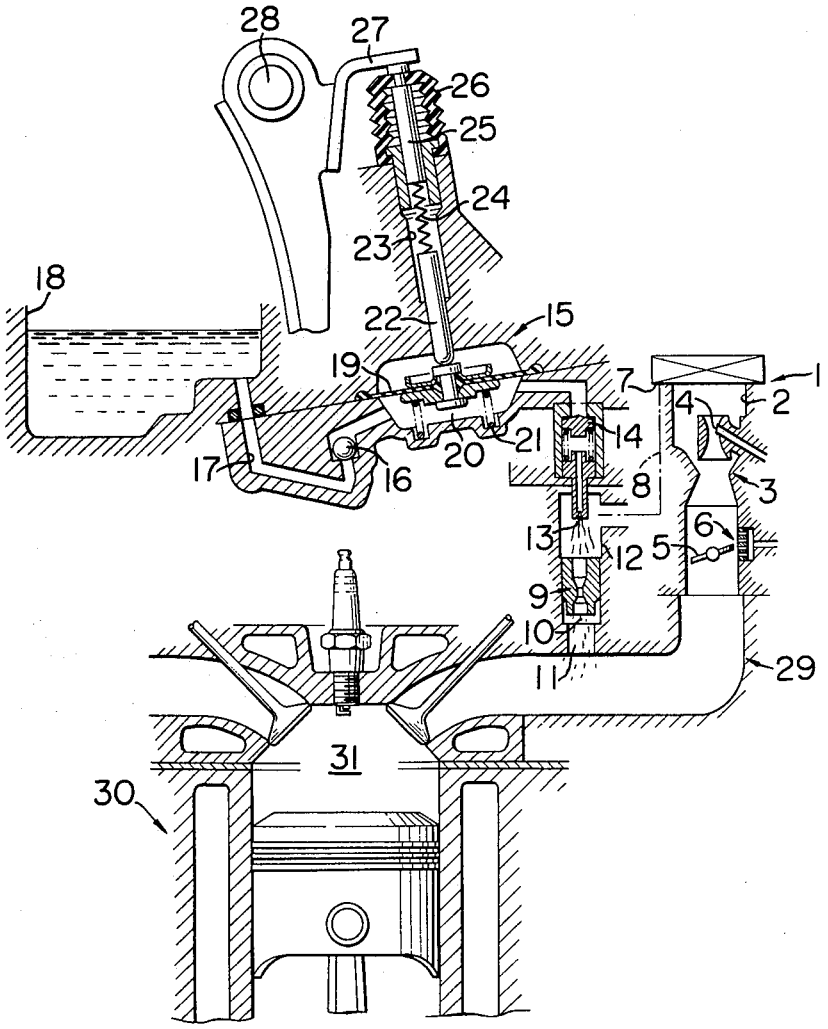
FIG. 6 is a sectional view showing the engine equipped with the carburetor in accordance with another embodiment of the present invention.

Turning now to FIG. 6, a venturi portion 3 is shown disposed inside an intake duct 2 of a carburetor 1 and a high speed spray aperture 4 is defined at this venturi portion 3 for feeding the fuel during the high speed operation of the engine. Inside the intake duct 2, a throttle valve 5 is disposed on the downstream side of the high speed spray aperture 4, and a low speed spray aperture 6, which feeds the fuel for the low speed operation of the engine in accordance with the degree of opening of the throttle valve 5, is formed on the side wall portion of the intake duct 2 at a position opposed the throttle valve 5. Downstream the throttle valve 5, this intake duct 2 is connected with an intake manifold 29 for distributing and feeding the air-fuel mixture to respective combustion chambers 31 of a plurality of cylinders 30.

On the side wall portion of the intake duct 2 on the upstream side with respect to the venturi portion 3, there is an intake port 7 of a by-pass passage 8, said intake port 7 opening to the intake duct 2 and sucking the air while detouring the throttle valve 5. On the side walls of the respective branch conduits of the manifold, there are disposed controlling stream spray ports 11 in the number corresponding to the number of cylinders 30 of the engine. Each controlling stream spray port 11 sprays, as a controlling stream, the air sucked through the by-pass passage 8 towards the downstream side of the manifold 29, thereby promoting the atomization of the fuel particles in the air-fuel mixture on the downstream side of the manifold 29.

Inside a guide passage 12 that forms the outlet portions of the by-pass passage 8, there are defined a controlling nozzle 9 and a jet stream adjusting chamber 10. The controlling nozzle 9 jets and accelerates the air sucked through the by-pass passage 8 towards the controlling spray port 11 while the jet stream adjusting chamber 9 converts, between the controlling nozzle 9 and the controlling stream spray port 11, the air sprayed from the controlling nozzle 9 into a suitable turbulent, dispersed air and jet it from the controlling stream spray port 11 into the intake duct 2.

An acceleration fuel nozzle 13 is open on the downstream side of the controlling nozzle 9 inside the guide passage 12. This acceleration fuel nozzle 13 is constructed such that it communicates with a fuel tank 18 via a discharge valve 14, a pump chamber 20 of an acceleration pump 15, an intake valve 16 and a fuel pipe 17. The acceleration pump 15 is a diaphragm pump, whose diaphragm 19 is under the bias of a restoring spring 21 on its one side and is urged by a push rod 22 on the other side, said push rod 22 sliding inside a slide contact hole 23. The push rod 22 is arranged inside the slide contact hole 23 to receive the pushing force of a pressure-receiving rod 25 via a push spring 24, and the pressure-receiving rod 25 has in turn its protruding portion protruding from its slide contact hole 23 and encompassed by a dust-proof bellows 26. The outer end portion of the pressure-receiving rod 25 is allowed to butt against a push arm 27 which is pivoted at a pivot portion 28. The push arm 27 is interlocked with the throttle valve 5 via a mechanism not shown in such an arrangement that is pushes the pressure-receiving rod 25 at the time of opening action of the throttle valve 5.

Thus, when the throttle valve 105 is rapidly opened so as to accelerate the engine revolution, the push arm 27 rapidly pushes the pressure-receiving rod 25 so that its pushing force is transmitted to the diaphragm 19 via the spring 24 and the push rod 22 and imparts the discharge action to the diaphragm 19. Incidentally, the fuel inside the pump chamber 20 is supplemented as the fuel inside the fuel tank 18 is sucked through the intake valve 16 due to the sucking action of the diaphragm 19 which is caused by the restoring force of the restoring spring 21 at the time of closing of the throttle valve 5.

The fuel fed into the acceleration fuel nozzle 13 is jetted into the air stream that passes through the guide passage 12. In this instance, the air stream jetted from the controlling nozzle 9 is fed into each controlling stream spray port 11 via the jet stream adjusting chamber 10, and the fuel particles in the air stream are further atomized in the course of jetting through the controlling nozzle 9 while the jet air stream sprayed from the controlling nozzle 9 is converted into a suitably turbulent flow to form a homogeneous air-fuel mixture inside the jet stream adjusting chamber 10. As the acceleration fuel is sprayed from the acceleration fuel nozzle 13, which is then sprayed into each cylinder 30 from each controlling stream spray port 11, the distribution of the acceleration fuel to each cylinder becomes uniform, thereby markedly improving the acceleration response characteristics of the engine. Incidentally, in the present invention, it is possible to arrange the controlling nozzles 9 and the controlling stream spray ports 11 for a single acceleration fuel nozzle 13 in the number corresponding to the number of the cylinders 30 or to arrange the controlling stream spray ports 11 for a single controlling nozzle 9 in the number corresponding to the number of the cylinders 30 of the engine.

Due to the construction described above, when the engine is actuated with the throttle valve 5 being slightly opened, the pressure inside the intake duct 29 downstream the throttle valve 5 lowers so that the low speed fuel is sucked from, and fed by, the low speed spray aperture 6 and the air is also sucked from the intake port 7 via the by-pass passage 8. The air sucked from this intake port 7 is sprayed into each branch conduit of the intake manifold. When the throttle valve 5 is rapidly opened in this instance and the acceleration fuel is thereby jetted from the acceleration fuel nozzle 13, the fuel particles thus jetted are atomized during their passage through the controlling nozzle 9 and the jet stream adjusting chamber 10 and are sprayed from each controlling stream spray port 11 into each branch conduit under the uniformly distributed state.

As the opening of the throttle valve 5 becomes greater, the air stream inside the intake duct 2 upstream the throttle valve 5 becomes more easy to flow towards the downstream side of the throttle valve 5 and at the same time, the sucking force acting on the slow speed spray aperture 6 becomes weaker. Consequently, the air-fuel mixture containing the fuel particles jetted from the high speed spray aperture 4 is primarily fed into the downstream side of the throttle valve 5.

What is claimed is:

1. A carburetor comprising: an intake duct; a throttle valve disposed in said intake duct; a low speed fuel spray aperture defined on the side wall portion of said intake duct at a position opposed to said throttle valve and feeding a fuel for low speed operation in accordance with the degree of opening of said throttle valve; a by-pass passage having an intake port and a controlling stream spray port; said intake port defined on the side wall portion of said intake duct at a position upstream of said throttle valve; said controlling stream spray port defined on the side wall portion of said intake duct at a position downstream of said throttle valve; a controlling nozzle disposed in said by-pass passage and generating a jet stream towards said controlling stream spray port and means spraying fuel during acceleration into said by-pass passage upstream of said controlling nozzle.

2. The carburetor as defined in claim 1 wherein said controlling stream spray port is defined in said intake duct at the same azimuth as that of said low speed spray aperture.

3. The carburetor as defined in claim 1 wherein said by-pass passage is equipped with a jet stream adjusting chamber defined between said controlling nozzle and said controlling stream spray port and controlling the jet stream sprayed from said controlling nozzle in such a manner that it is sprayed from said controlling stream spray port into said intake duct under the state of a controlled flow.

4. A carburetor comprising: an intake duct; a throttle valve disposed in said intake duct; a low speed fuel spray aperture defined on the side wall portion of said intake duct at a position opposed to said throttle valve and feeding a fuel for low speed operation in accordance with the degree of opening of said throttle valve; a by-pass passage having an intake port and a controlling stream spray port; said intake port defined on the side wall portion of said intake duct at a position upstream of said throttle valve; said controlling stream spray port defined on the side wall portion of said intake duct at a position downstream of said throttle valve; a controlling nozzle disposed in said by-pass passage and generating a jet stream towards said controlling stream spray port; and a jet stream adjusting chamber defined between said controlling nozzle and said controlling stream spray port and controlling the jet stream sprayed from said controlling nozzle in such a manner that it is sprayed from said controlling stream spray port into said intake duct under the state of a controlled flow; the cross-sectional area $S_1$ of said controlling stream spray port and the cross-sectional area $S_2$ of the minimum diameter portion of said controlling nozzle being defined to satisfy a relationship of $S_1 \geqq 1.8S_2$ and means spraying fuel during acceleration into said by-pass passage upstream of said controlling nozzle.

5. The carburetor as defined in claim 4 wherein said controlling stream spray port is defined in said intake duct at the same azimuth as that of said low speed spray aperture, and the open width $W_1$ of said controlling stream spray port along the inner circumferential direction of said intake duct and the maximum distribution width $W_2$ of said low speed spray aperture along the inner circumferential direction of said intake duct are defined to satisfy a relationship of $W_1/W_2=0.45–4.0$.

6. A carburetor comprising: an intake duct; a throttle valve disposed in said intake duct; a low speed fuel spray aperture defined on the side wall portion of said intake duct at a posiion opposed said throttle valve and feeding a fuel for low speed operation in accordance with the degree of opening of said throttle valve; a by-pass passage having an intake port and a controlling stream spray port; said intake port defined on the side wall portion of said intake duct at a position upstream of said throttle valve; said controlling stream spray port defined on the side wall portion of said intake duct at a position downstream of said throttle valve; a controlling nozzle disposed in said by-pass passage and generating a jet stream towards said controlling stream spray port; and an acceleration fuel nozzle opening inside said by-pass passage on the upstream side of said controlling nozzle and spraying an acceleration fuel into said by-pass passage.

7. A carburetor for use in an engine having a plurality of cylinders, said carburetor comprising: an intake duct; an intake manifold connected with said intake duct and having branch conduits leading to respective combustion chambers of said cylinders; a throttle valve disposed in said intake duct; a low speed fuel spray aperture defined on the side wall portion of said intake duct at a position opposed said throttle valve and feeding a fuel for low speed operation in accordance with the degree of opening of said throttle valve; a by-pass passage having an intake port and a plurality of controlling stream spray ports, said intake port being defined on the side wall portion of said intake duct at a position upstream of said throttle valve, said controlling stream spray ports being defined on the side wall portions of said respective branch conduits; controlling nozzle means disposed in said by-pass passage and generating a jet stream towards each of said controlling stream spray ports; and an acceleration fuel nozzle opening into said by-pass passage on the upstream side of said controlling nozzle means for spraying an acceleration fuel into said by-pass passage.

* * * * *